US009528066B2

(12) United States Patent
Sui et al.

(10) Patent No.: US 9,528,066 B2
(45) Date of Patent: Dec. 27, 2016

(54) HIGH-TEMPERATURE LUBRICANTS COMPRISING ELONGATED CARBON NANOPARTICLES FOR USE IN SUBTERRANEAN FORMATION OPERATIONS

(71) Applicant: Halliburton Energy Services, Inc., Houston, TX (US)

(72) Inventors: Ping Sui, The Woodlands, TX (US); David Duckworth, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 304 days.

(21) Appl. No.: 14/329,151

(22) Filed: Jul. 11, 2014

(65) Prior Publication Data

US 2016/0010022 A1 Jan. 14, 2016

Related U.S. Application Data

(63) Continuation of application No. 14/371,829, filed as application No. PCT/US2013/057530 on Aug. 30, 2013.

(51) Int. Cl.

| | |
|---|---|
| ***E21B 10/24*** | (2006.01) |
| ***C10M 125/02*** | (2006.01) |
| ***C10M 173/02*** | (2006.01) |

(52) U.S. Cl.

CPC ..... *C10M 125/02* (2013.01); *C10M 173/02* (2013.01); *E21B 10/24* (2013.01);

(Continued)

(58) Field of Classification Search

CPC ..... E21B 10/22; E21B 10/24; C10M 113/02; C10M 125/02; C10M 169/04; C10M 171/06; C10M 2210/041; C10M 2210/0416

(Continued)

(56) References Cited

U.S. PATENT DOCUMENTS

| | | | |
|---|---|---|---|
| 5,480,269 | A | 1/1996 | Ejiri et al. |
| 5,905,061 | A | 5/1999 | Patel |

(Continued)

FOREIGN PATENT DOCUMENTS

| | | | |
|---|---|---|---|
| CA | 2598648 | A1 | 7/2006 |
| CN | 103013466 | A | 4/2013 |

(Continued)

OTHER PUBLICATIONS

V. Eswaraiah, "Carbon Nanotubes and Graphene Based Polymer Nanocomposites for Strain Sensing, EMI Sheilding, and Nanolubricant Applications," Indian Institute of Technology Madras (Dec. 2011).

(Continued)

*Primary Examiner* — Kenneth L Thompson

(74) *Attorney, Agent, or Firm* — McDermott Will & Emery LLP; Alan Bryson

(57) ABSTRACT

An embodiment disclosed herein provides a high-temperature lubricant comprising an oil-soluble lubricating base fluid or a water-soluble lubricating base fluid; and elongated carbon nanoparticles that align in flow. In some embodiments, the lubricating composition may be selected from the group consisting of graphene nanoribbons; carbon nanotubes; carbon nanohorns; and any combination thereof.

12 Claims, 4 Drawing Sheets

(52) U.S. Cl.
CPC ... *C10M 2201/041* (2013.01); *C10M 2201/14* (2013.01); *C10M 2203/1006* (2013.01); *C10M 2203/1085* (2013.01); *C10M 2207/0215* (2013.01); *C10M 2207/0225* (2013.01); *C10M 2207/0406* (2013.01); *C10M 2207/1253* (2013.01); *C10M 2207/2805* (2013.01); *C10M 2207/401* (2013.01); *C10M 2209/1033* (2013.01); *C10M 2209/1085* (2013.01); *C10M 2229/025* (2013.01); *C10N 2220/082* (2013.01)

(58) Field of Classification Search
USPC .. 175/371, 372; 977/778, 902, 963; 508/113
See application file for complete search history.

(56) References Cited

U.S. PATENT DOCUMENTS

| | | | | |
|---|---|---|---|---|
| 5,977,031 | A | 11/1999 | Patel | |
| 6,828,279 | B2 | 12/2004 | Patel et al. | |
| 7,013,998 | B2 * | 3/2006 | Ray | E21B 10/25 175/371 |
| 7,316,789 | B2 | 1/2008 | Lu | |
| RE40,197 | E * | 4/2008 | Ray | E21B 10/25 175/371 |
| 7,449,432 | B2 * | 11/2008 | Lockwood | B82Y 30/00 508/113 |
| 7,534,745 | B2 | 5/2009 | Taylor et al. | |
| 7,645,723 | B2 | 1/2010 | Kirsner et al. | |
| 7,696,131 | B2 | 4/2010 | Oyler et al. | |
| 7,749,947 | B2 * | 7/2010 | Griffo | C10M 125/02 175/331 |
| 7,871,533 | B1 | 1/2011 | Haiping et al. | |
| 8,076,809 | B2 * | 12/2011 | Tingler | B82Y 30/00 310/87 |
| 8,196,682 | B2 * | 6/2012 | Dick | E21B 10/22 175/359 |
| 8,222,190 | B2 | 7/2012 | Zhamu et al. | |
| 8,347,986 | B2 | 1/2013 | Anderele | |
| 8,356,667 | B2 | 1/2013 | Quintero et al. | |
| 8,459,379 | B2 * | 6/2013 | Sui | E21B 4/003 175/371 |
| 8,551,576 | B2 * | 10/2013 | Mordukhovich | F16C 33/04 427/475 |
| 8,741,819 | B2 * | 6/2014 | Baran, Jr. | C10M 139/04 508/100 |
| 8,840,803 | B2 * | 9/2014 | Mazyar | E21B 43/128 165/104.11 |
| 8,951,942 | B2 * | 2/2015 | Pick | C10M 113/02 508/113 |
| 9,023,771 | B2 * | 5/2015 | Mabuchi | C10M 169/04 508/113 |
| 9,080,122 | B2 * | 7/2015 | Kwon | C10M 125/02 |
| 2002/0012675 | A1 | 1/2002 | Jain et al. | |
| 2003/0151030 | A1 | 8/2003 | Gurin | |
| 2005/0016726 | A1 | 1/2005 | Nguyen et al. | |
| 2005/0109544 | A1 | 5/2005 | Ray et al. | |
| 2006/0001013 | A1 | 1/2006 | Dupire et al. | |
| 2007/0158609 | A1 * | 7/2007 | Hong | B82Y 30/00 252/71 |
| 2008/0287326 | A1 * | 11/2008 | Zhang | C10M 103/02 508/113 |
| 2009/0183877 | A1 | 7/2009 | Quintero et al. | |
| 2010/0187925 | A1 | 7/2010 | Tingler et al. | |
| 2011/0046027 | A1 * | 2/2011 | Zhamu | C10M 103/02 508/113 |
| 2011/0059871 | A1 | 3/2011 | Tour et al. | |
| 2011/0168450 | A1 * | 7/2011 | Sui | E21B 10/25 175/371 |
| 2012/0015852 | A1 | 1/2012 | Quintero et al. | |
| 2012/0024632 | A1 | 2/2012 | John | |
| 2012/0032543 | A1 * | 2/2012 | Chakraborty | B82Y 30/00 310/90 |
| 2012/0235080 | A1 | 9/2012 | Hong et al. | |
| 2012/0245085 | A1 | 9/2012 | Naver et al. | |
| 2015/0252280 | A1 * | 9/2015 | Hatfield | C10M 125/22 508/167 |

FOREIGN PATENT DOCUMENTS

| | | | |
|---|---|---|---|
| EP | 2558545 | A1 | 2/2013 |
| WO | 2012106090 | A2 | 8/2012 |
| WO | 2013113009 | A1 | 8/2013 |
| WO | 2015030794 | A1 | 3/2015 |

OTHER PUBLICATIONS

Modification of Graphene Platelets and Their Tribological Properties as a Lubricant Additive, Tribology Letters 2011 vol. 41:209-215.

K. W. Street, et al., "Application of Carbon Based Nano-Materials to Aeronautics and Space Lubrication," NASA/TM-2007-214473.

Anni Siitonen, et al, "Spectroscopy and Ultrafast Dynamics of Nanotubes, Surfactant and structure-dependent exciton mobility in SWCNTs," 2010.

Gupta, et al., Polymer Nanocomposites, Overview of Challenges and Opportunities, 2010.

International Search Report and Written Opinion for PCT/US2013/057530 dated May 19, 2014.

Lin, et al. "Modification of Graphene Platelets and their Tribological Properties as a Lubricant Additive," Tribology Letters 2011 vol. 41:209-215, DOI: 10.1007/S11249-010-9702-5, received Apr. 18, 2010, published online Oct. 6, 2010 (c) Springer Science+Business Media, LLC 2010.

* cited by examiner

HIGH-TEMPERATURE LUBRICANTS COMPRISING ELONGATED CARBON NANOPARTICLES FOR USE IN SUBTERRANEAN FORMATION OPERATIONS

BACKGROUND

The methods of the embodiments described herein relate to high-temperature lubricants comprising elongated carbon nanoparticles for use in downhole cutting tools and methods for their manufacture.

As used herein, the term "downhole cutting tool" in all of its forms refers to any variety of downhole tools that can be operated to form a well bore in the ground by drilling, such as to reach a desired subterranean formation. Examples of downhole cutting tools include, but are not limited to, a roller cone bit, a polycrystalline diamond compact bit, a drag bit, an impregnated bit, a reamer with cutting elements, and the like. A downhole cutting tool includes cutting elements that help the cutting tool penetrate the ground by liberating earthen materials, such as by shearing or crushing adjacent formation materials contacted by the cutting elements. Associated drilling technologies, such as the circulation of drilling fluids down through a drill string and up through an annulus formed between the drill string and the well bore, are used to continually remove formation materials and other debris from the well bore. The rate of penetration of a downhole cutting tool is one measure of drilling efficiency. As used herein, the term "rate of penetration" ("ROP") refers to the rate at which a hole can be drilled in the ground. ROP may be expressed in terms of depth over time that a well bore is formed when drilling, such as in feet per hour.

A downhole cutting tool has to be replaced periodically due to wear on certain components, such as bearings, bearing assemblies, bearing surfaces, seals, and other supporting structures (collectively referred to herein as "supporting structures"). Replacing worn parts typically requires time-consuming steps, such as ceasing drilling operations, removing (i.e., "tripping out") the drilling assembly from the well bore, replacing the supporting structures or the entire downhole cutting tool, and tripping the drilling assembly back down the well bore to continue drilling. The downtime associated with such replacement is costly. Because lubrication reduces friction and associated wear between moving parts, lubricants are often used to lubricate the supporting structures in downhole cutting tools. Lubrication thus extends the life of downhole cutting tools and, thus, the time between any required replacement.

BRIEF DESCRIPTION OF THE DRAWINGS

The following figures are included to illustrate certain aspects of the exemplary embodiments described herein, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
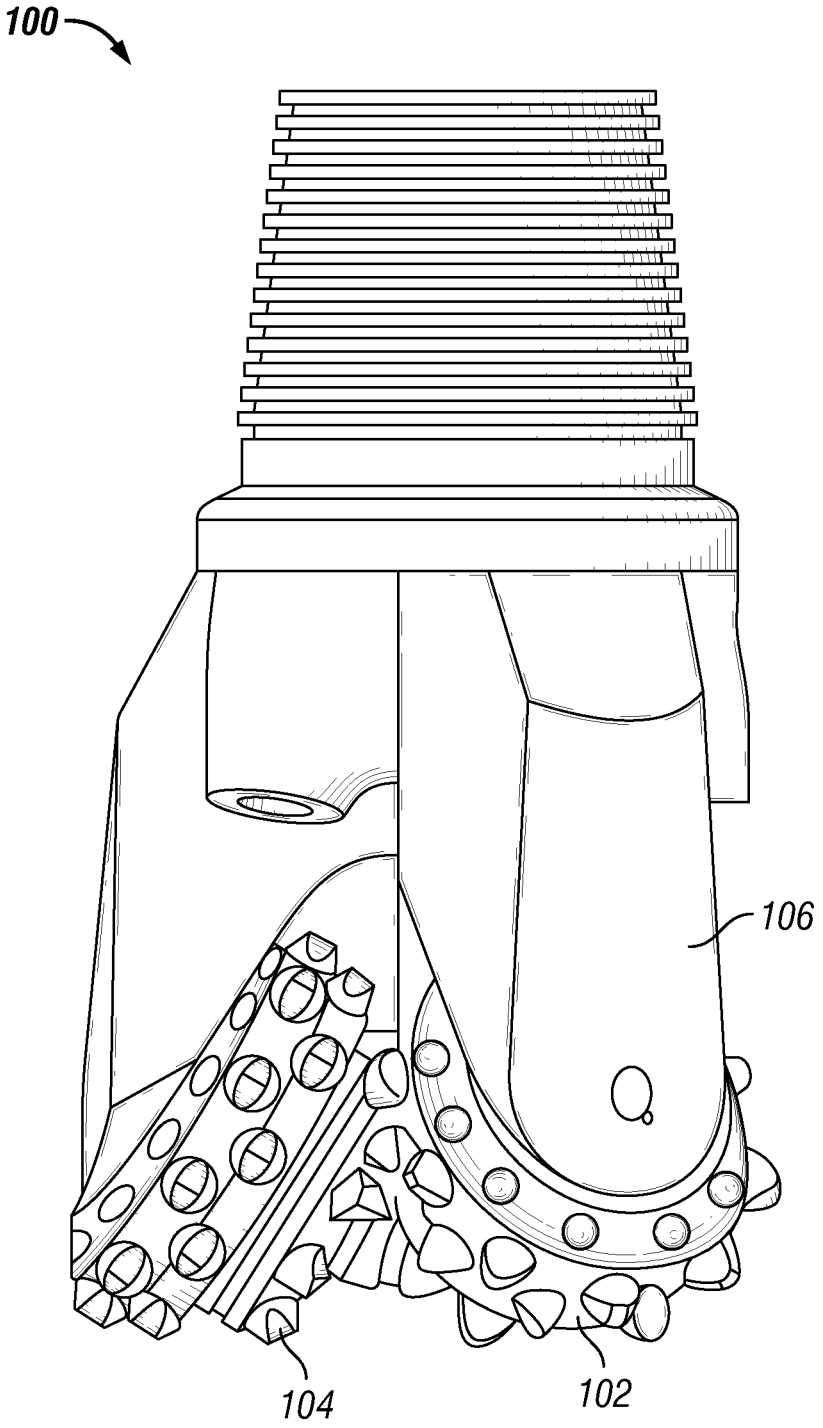
FIG. 1 provides a diagram of a roller cone bit.

The methods of the embodiments described herein relate to high-temperature lubricants comprising elongated carbon nanoparticles for use in downhole cutting tools and methods for their manufacture.

Although the embodiments disclosed herein focus on providing high-temperature lubricants comprising elongated carbon nanoparticles (also referred to herein simply as "lubricants") for use in subterranean formation drill cutting tools, the lubricants may be effectively used in any other subterranean formation treatment equipment or operation that may benefit from a lubricious fluid. Such treatment operations may include equipment used in operations including, but not limited to, a lost circulation operation; a stimulation operation; a sand control operation; a completion operation; an acidizing operation; a scale inhibiting operation; a water-blocking operation; a clay stabilizer operation; a fracturing operation; a frac-packing operation; a gravel packing operation; a well bore strengthening operation; a sag control operation; and any combination thereof.

Moreover, the lubricants comprising elongated carbon nanoparticles as described in some embodiments herein may be used in any non-subterranean formation operation that may benefit from a lubricous fluid. Such operations may be performed in any industry including, but not limited to, oil and gas, mining, chemical, pulp and paper, converting, aerospace, medical, automotive, and the like.

One or more illustrative embodiments according to the disclosure are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

Figure 2:
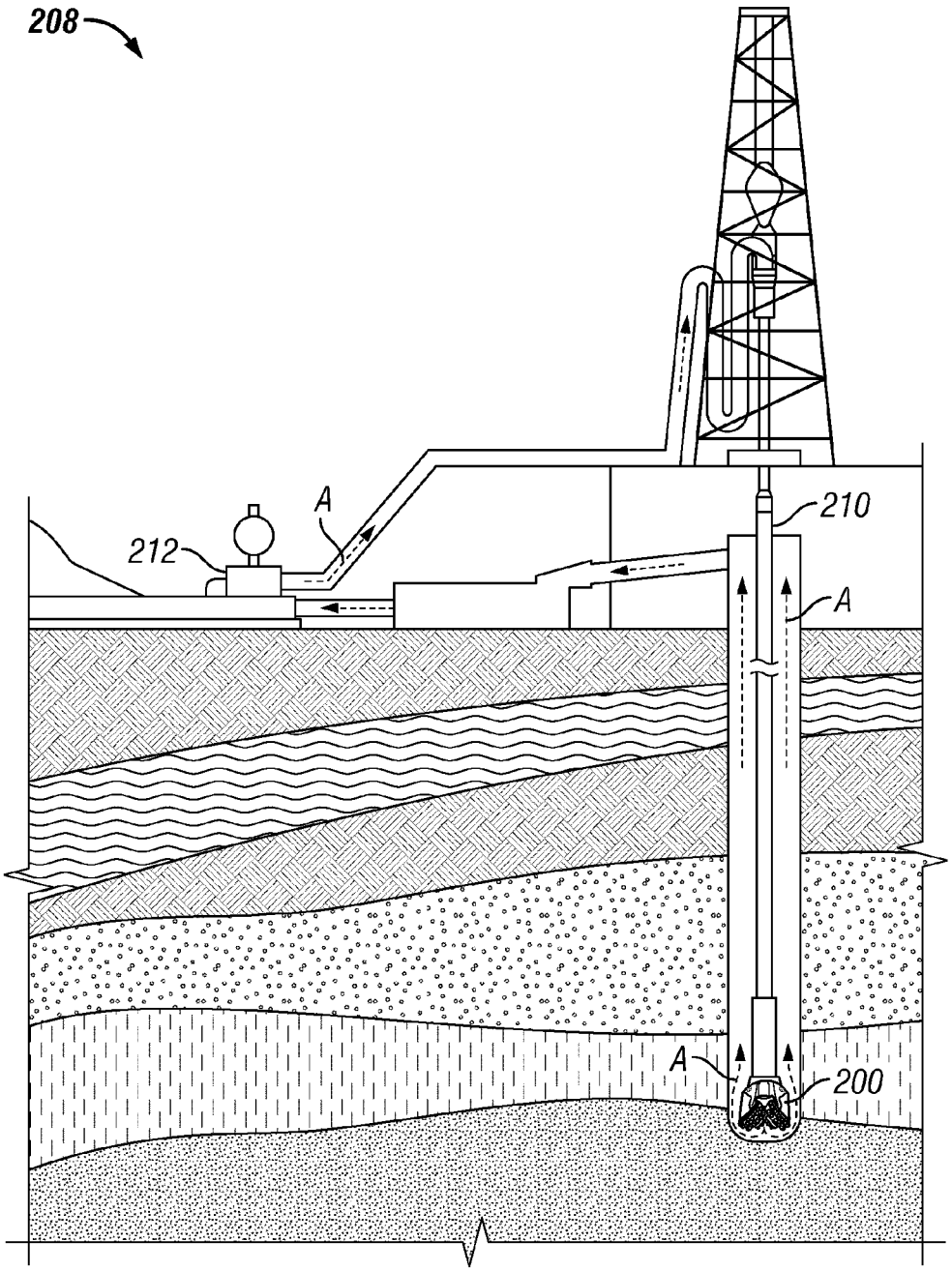
FIG. 2 illustrates a system suitable for drilling a well bore penetrating a subterranean formation.

An important type of downhole cutting tool used in well bore drilling is the roller cone bit, illustrated in FIG. 1 as 100. In a roller cone bit, rotating cones 102 have inserts 104 on their outer surface and are mounted on one or more arms 106 of the drill body. During drilling, as illustrated in FIG. 2, a drill rig 208 uses sections of pipe 210 transfer rotational force to a roller cone bit 200 and pump 212 to circulate drilling fluid (as illustrated as flow arrows A) to the bottom of the well bore through the sections of pipe 210. As the roller cone bit rotates, the applied weight-on-bit ("WOB") forces the downward pointing inserts of the rotating cones into the formation being drilled. Thus, the points of the inserts apply a compressive stress that exceeds the yield stress of the formation, causing a well bore to be formed. The resulting fragments (also referred to as "cuttings") are flushed away from the cutting face by a high flow of drilling fluid.

Roller cone bits generally include one or more support arms and a cone assembly that may be rotatably mounted to an interior portion of each support arm. Each cone assembly may include a base with a cavity or opening formed therein that may be sized to receive exterior portions of a spindle to allow rotation of the cone assembly relative to the associated spindle while drilling a well bore. A variety of bearings, bearing assemblies, bearing surfaces, seals, and/or other supporting structures may be disposed between interior portions of each cone assembly and exterior portions of the associated spindle. These bearings, bearing assemblies, bearing surfaces, seals, and/or other supporting structures may be surrounded by lubricant that may be enclosed and isolated from other well bore fluids (e.g., drilling fluids). Such lubricants may reduce rotary (i.e., torque) and axial (i.e., drag) forces, reduce equivalent circulating densities, reduce mechanical wear to the downhole cutting tool, and the like. As such, lubricants may reduce the costs associated with drilling and increase drilling efficiency, which may be particularly heightened in deviated or horizontal well bores.

Figure 3:
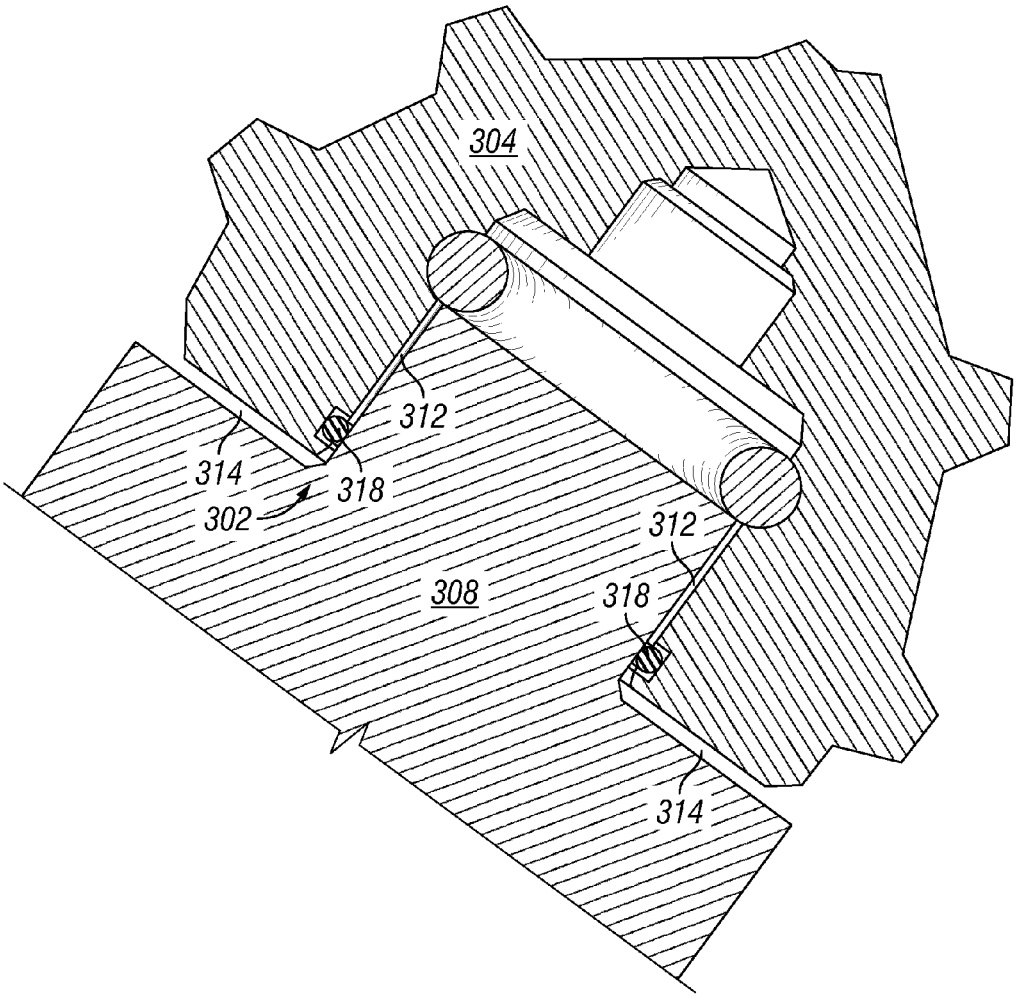
FIG. 3 provides a cross-sectional diagram of a portion of a roller cone bit comprising a high-temperature lubricant of at least one embodiment described herein.

Referring now to FIG. 3, a cross-sectional diagram of a portion of a roller cone bit, rotary joint 302 is defined by two elements: first element 304 illustrated as a roller cone and second element 308 illustrated as a support arm with spindle. Supporting structure 318 (e.g., a bearing, bearing assembly, a seal, and the like) is configured to seal a portion of the rotary joint 302, thereby defining sealed segment 312 and unsealed segment 314. The lubricants comprising elongated carbon nanoparticles as disclosed in some embodiments herein may be located in sealed segment 312, such that the lubricant is isolated from other fluids used during drilling operations. The lubricant may be placed in sealed segment 312 by any methods known in the art, such as by use of a sealed lubricant supplying assembly embedded in the roller cone bit, and the like.

In some embodiments disclosed herein, a lubricant is disclosed comprising an oil-soluble lubricating base fluid or a water-soluble lubricating base fluid and elongated carbon nanoparticles that align in flow. In other embodiments, a drill bit is disclosed herein comprising a rotary joint defining a sealed segment and an unsealed segment, wherein the sealed segment comprises a lubricant comprising an oil-soluble lubricating base fluid or a water-soluble lubricating base fluid and elongated carbon nanoparticles that align in flow. In still other embodiments, a method of drilling a subterranean formation is disclosed herein comprising providing a drill bit comprising a rotary joint defining a sealed segment and an unsealed segment, wherein the sealed segment comprises a lubricant comprising an oil-soluble lubricating base fluid or a water-soluble lubricating base fluid and elongated carbon nanoparticles that align in flow; and drilling a well bore in the subterranean formation with the drill bit.

Suitable oil-soluble lubricating base fluids may include, but are not limited to, animal oil; vegetable oil; mineral oil; diesel oil, crude oil; a petroleum derivative; a glycol; an ester; a silicone; a stearate; a polyoxyethylene; an oil-soluble polymer; and any combination thereof. In some embodiments, the oil-soluble lubricating base fluids may have a degradation temperature of greater than about 200° C. In other embodiments, the oil-soluble lubricating base fluids may have a degradation temperature in the range of from a lower range of about 200° C., 225° C., 250° C., 275° C., 300° C., 325° C., and 350° C. to an upper range of about 500° C., 475° C., 450° C., 425° C., 400° C., 375° C., and 350° C.

Suitable water-soluble lubricating base fluids may include, but are not limited to, an aliphatic alcohol; a polyalkylene glycol; a di(alkylene)glycol; a monoalkyl ether of an alkylene glycol; a monoalkyl ether of a di(alkylene) glycol; and any combination thereof. In some embodiments, the oil-soluble lubricating base fluids may have a degradation temperature of greater than about 120° C. In other embodiments, the oil-soluble lubricating base fluids may have a degradation temperature in the range of from a lower range of about 120° C., 150° C., 175° C., 200° C., 225° C., 250° C., 275° C., 300° C., 325° C., and 350° C. to an upper range of about 500° C., 475° C., 450° C., 425° C., 400° C., 375° C., and 350° C. The high degradation temperature of the oil-soluble lubricating base fluids and the water-soluble lubricating base fluids may be particularly useful in subterranean formations having high temperatures, and in drilling at high temperature, high pressure conditions.

In some cases, the oil-soluble or water-soluble lubricating base fluids may further comprise a thickening agent such as, for example, a metal soap; clay; silica; asbestos; an oxide; a phosphate; and any combination thereof. One of ordinary skill in the art, with the benefit of this disclosure will recognize the appropriate type of lubricating base fluid to include in the lubricant compositions of the embodiments described herein. While compositions and methods are described in terms of "comprising" various components or steps, the compositions and methods can also "consist essentially of" or "consist of" the various components and steps. When "comprising" is used in a claim or in this disclosure, it is open-ended.

The elongated carbon nanoparticles described in some embodiments herein may take multiple forms, such as, for example, graphene nanoribbons; carbon nanotubes; carbon nanohorns; and any combination thereof. Graphene nanoribbons ("GNRs") are long strips of graphene formed from unzipped carbon nanotubes that may be from about 5 nm to about 50 nm wide, and from about 100 nm to about 2 μm long. In other embodiments, GNRs may be from about 5 nm to about 30 nm wide, and from about 500 nm to about 1 μm long. In still other embodiments, GNRs may be from about 5 nm to about 30 nm wide, and from about 100 nm to about 500 nm long. The width and length ranges of the graphene nanoribbons disclosed herein may be any size outside of these ranges based on certain factors known by those of ordinary skill in the art including, but not limited to, the type of base fluid used, the method of synthesis of the graphene nanoribbon, the amount of lubricity desired, the conditions of the subterranean formation, and the like. As used herein, the term "graphene" encompasses few-layered graphene and the term "graphene nanoribbons" encompasses few-layered graphene nanoribbons. Carbon nanotubes are allotropes of carbon having a cylindrical structure. For use in the embodiments described herein, such carbon nanotubes may be single-walled carbon nanotubes ("SWNTs") or multi-walled carbon nanotubes ("MWNTs") (e.g., having 2 to 50 or more walls than SWNTs). Carbon nanohorns ("CNHs") are allotropes of carbon and, similar to carbon nanotubes, are elongated, predominantly cylindrical structures with tapered or horn-like ends. In some embodiments, the elongated carbon nanoparticles may be present in the lubricants of the embodiments described herein in an amount in the range of from about 1% to about 80% by weight of the oil-soluble or water-soluble lubricating base fluids. In other embodiments, the elongated carbon nanoparticles may be present in the lubricants of the embodiments described herein in an amount in the range of from about 15% to about 50% by weight of the oil-soluble or water-soluble lubricating base fluids.

The elongated carbon nanoparticles may impart additional lubricity to the oil-soluble or water-soluble lubricating base fluids of the embodiments described herein when used alone, as they may further reduce the coefficient of friction of the lubricating base fluids. The reduced coefficient of friction may be attributed to the low shear nature of the elongated carbon nanoparticles. Additionally, the elongated carbon nanoparticles may prevent or reduce metal oxidation (e.g., corrosion) when present at sliding metal contact surfaces (e.g., between bearings and other metal surfaces). Due to the tensile strength of the elongated carbon nanoparticles, they may further aid ensuring that the lubricants disclosed herein possess the desired lubricity for a prolonged period of time and under extreme temperature and/or pressure conditions, as they are resistant to degradation.

The elongated carbon nanoparticles for use in the lubricants of the embodiments described herein may be synthesized (or "grown") by any means known in the art. The elongated carbon nanoparticles may be synthesized by methods including, but not limited to, epitaxial growth substrates (e.g., ruthenium, iridium, nickel, copper, cobalt, chromium, stainless steel, silicon carbide, titania, alumina, silica, sapphire, and the like); chemical vapor deposition; laser ablation; arc discharge; plasma torch; nanotube unzipping; and the like.

The elongated carbon nanoparticles of the embodiments disclosed herein are capable of aligning in flow in the oil-soluble or water-soluble lubricating base fluids. That is, when the oil-soluble or water-soluble lubricating base fluids experience friction, the elongated carbon nanoparticles will align. As used herein, the term "aligned" in all of its forms refers to the orientation of the elongated carbon nanoparticles in the same directional plane. The alignment of the elongated carbon nanoparticles may aid in imparting lubricity to the lubricants as such an orientation may permit surfaces that encounter the lubricants (e.g., the supporting structures within the sealed segment of a downhole cutting tool) to encounter an increased surface area of the elongated carbon nanoparticles than would be the case if the elongated carbon nanoparticles were not aligned. The size and shape of the elongated carbon nanoparticles, as described above, may aid in permitting natural alignment when the elongated carbon nanoparticles encounter friction in the oil-soluble or water-soluble lubricating base fluids.

In some embodiments, the elongated carbon nanoparticles of the embodiments disclosed herein may be functionalized. Functionalization may aid in solubilizing and incorporating the elongated carbon nanoparticles into the oil-soluble or water-soluble lubricating base fluids. The elongated carbon nanoparticles described in some embodiments herein may comprise oxygen-containing functional groups (e.g., —OH, —COOH, and the like) that may beneficially serve as chemical handles for functionalization. Functionalization may be accomplished by use of any moiety that aids in incorporating the elongated carbon nanoparticles into the oil-soluble or water-soluble lubricating base fluids.

In some embodiments, the elongated carbon nanoparticles may be functionalized with a water-solubilizing group; an oil-solubilizing group; and any combination thereof. Examples of suitable water-solubilizing groups include, but are not limited to, a carboxyl group; a sulfonate group; a sulfate group; a phosphate group; a phosphonate group; a saccharide group; a nucleoside group; a nucleotide group; a peptide group; a glycol group; a polyethylene oxide group; a polyethylene glycol group; a hydroxyl group; a sulfuric acid ester group; an epoxide group; an aldehyde group; a carbonyl group; a haloformyl group; a carbonate ester group; an ester group; a methoxy group; a hydroperoxy group; a peroxy group; an ether group; a meiacetal group; a meniketal group; an acetal group; an orthoester group; an orthocarbonate ester group; and any combination thereof. Examples of suitable oil-solubilizing groups include, but are not limited to, a hydrocarbyl group. Examples of hydrocarbyl groups for use as the oil-solubilizing groups in some embodiments disclosed herein include, but are not limited to, an alkyl group; an alkenyl group; an alkynyl group; a phenyl group; an aryl group; a cycloalkyl group; a prenyl group; a trityl group; a methanidyl group; a adamantan-2-yl group; a cycloalkenyl group; a cycloalkatrienyl group; a cycloalkadienyl group; a $C_{60}$ fullerene group; and any combination thereof.

Figure 4:
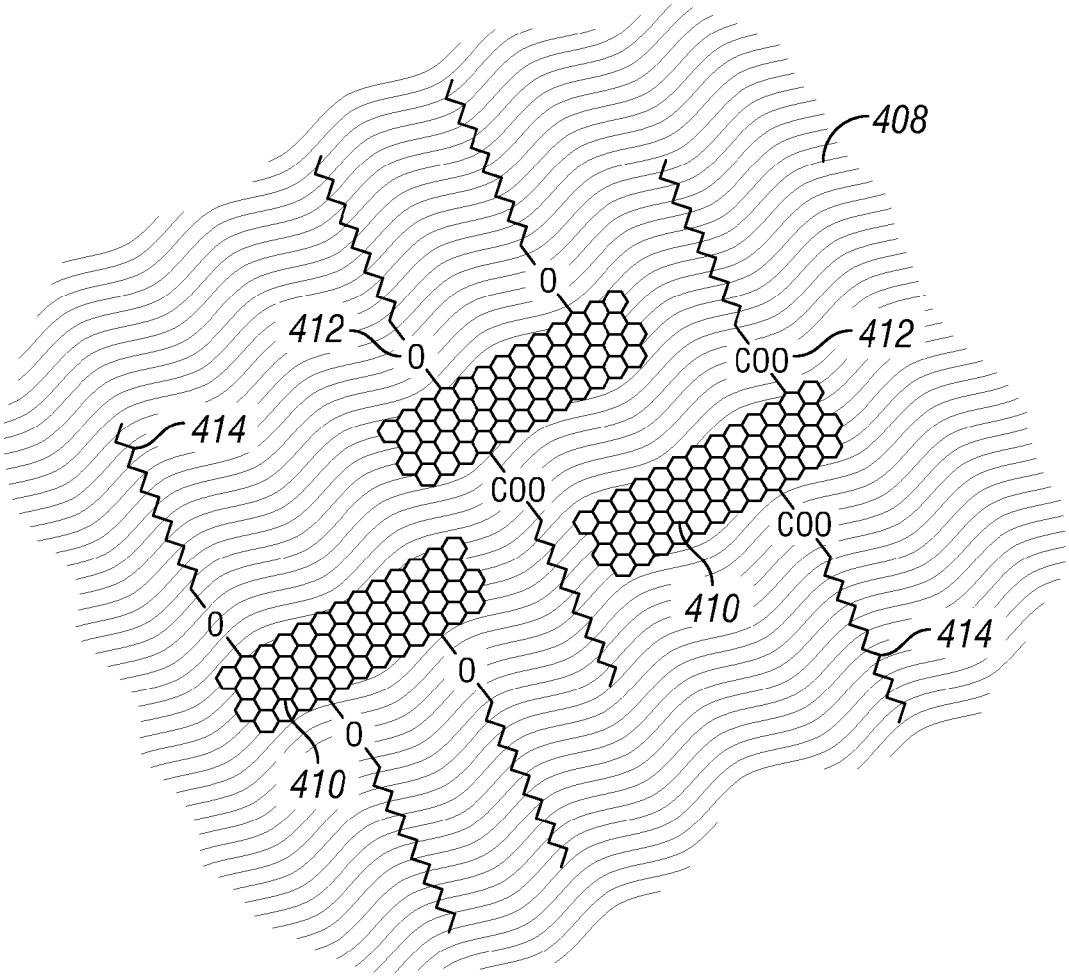
FIG. 4 provides a view of functionalized aligned elongated carbon nanoparticles in a high-temperature lubricant of at least one embodiment described herein.

Referring now to FIG. 4, elongated carbon nanoparticles 410 as disclosed in some embodiments herein are shown in alignment (e.g., in the same directional plane). Chemical handles 412 are functionalized with functional groups (either water-solubilizing or oil-solubilizing functional groups) 414. The functional groups 414 aid in solubilizing the elongated carbon nanoparticles 410 in the water-soluble or oil-soluble lubricating base fluid 408 to form the lubricants disclosed herein.

The choice of one or more particular groups for use in functionalizing the elongated carbon nanoparticles disclosed in some embodiments herein will be readily apparent, with the benefit of this disclosure, to one of ordinary skill in the art. Factors that may affect the choice of the particular water-solubilizing and/or oil-solubilizing groups may include, but are not limited to, the type of oil-soluble or water-soluble lubricating base fluid selected (e.g., a water-solubilizing group may be preferred if a water-soluble lubricating base fluid is selected, whereas an oil-solubilizing group may be preferred if an oil-soluble lubricating base fluid is selected), the conditions expected to be encountered by the elongated carbon nanoparticles while in use during a subterranean operation (e.g., temperature), and the like.

Embodiments disclosed herein include:

A. A drill bit comprising: a rotary joint defining a sealed segment and an unsealed segment, wherein the sealed segment comprises a high-temperature lubricant comprising an oil-soluble lubricating base fluid or a water-soluble lubricating base fluid and elongated carbon nanoparticles that align in flow in response to frictional forces in the oil-soluble lubricating base fluid or the water-soluble lubricating base fluid.

B. A method of drilling a subterranean formation comprising: providing a drill bit comprising a rotary joint defining a sealed segment and an unsealed segment, wherein the sealed segment comprises a high-temperature lubricant comprising an oil-soluble lubricating base fluid or a water-soluble lubricating base fluid and elongated carbon nanoparticles that align in flow in response to frictional forces in the oil-soluble lubricating base fluid or the water-soluble lubricating base fluid; and drilling a well bore in the subterranean formation with the drill bit.

C. A high-temperature lubricant comprising: an oil-soluble lubricating base fluid having a decomposition temperature of greater than about 200° C.; and elongated nanoparticles that align in flow in response to frictional forces in the oil-soluble lubricating base fluid, wherein the elongated nanoparticles are functionalized with an oil-solubilizing group selected from the group consisting of a hydrocarbyl group selected from the group consisting of an alkyl group; an alkenyl group; an alkynyl group; a phenyl group; an aryl group; a cycloalkyl group; a prenyl group; a trityl group; a methanidyl group; a adamantan-2-yl group; a cycloalkenyl group; a cycloalkatrienyl group; a cycloalkadienyl group; a $C_{60}$ fullerene group; and any combination thereof, and wherein functionalization at least partially solubilizes the elongated carbon nanoparticles into the oil-soluble lubricating base fluid.

D. A high-temperature lubricant comprising: a water-soluble lubricating base fluid having a decomposition temperature of greater than about 120° C.; and elongated nanoparticles that align in flow in response to frictional forces in the water-soluble lubricating base fluid, wherein the elongated nanoparticles are functionalized with a water-solubilizing group selected from the group consisting of a carboxyl group; a sulfonate group; a sulfate group; a phosphate group; a phosphonate group; a saccharide group; a nucleoside group; a nucleotide group; a peptide group; a glycol group; a polyethylene oxide group; a polyethylene glycol group; a hydroxyl group; a sulfuric acid ester group; an epoxide group; an aldehyde group; a carbonyl group; a haloformyl group; a carbonate ester group; an ester group; a methoxy group; a hydroperoxy group; a peroxy group; an ether group; a meiacetal group; a meniketal group; an acetal group; an orthoester group; an orthocarbonate ester group; and any combination thereof, and wherein functionalization at least partially solubilizes the elongated carbon nanoparticles into the water-soluble lubricating base fluid.

Each of embodiments A, B, C, and D may have one or more of the following additional elements in any combination:

Element 1: Wherein the oil-soluble lubricating base fluid has a decomposition temperature of greater than about 200° C.

Element 2: Wherein the water-soluble lubricating base fluid has a decomposition temperature of greater than about 120° C.

Element 3: Wherein the elongated carbon nanoparticles are selected from the group consisting of graphene nanoribbons; carbon nanotubes; carbon nanohorns; and any combination thereof.

Element 4: Wherein the graphene nanoribbons are in the range of from about 5 nm to about 50 nm in width and in the range of from about 100 nm to about 2 μm in length.

Element 5: Wherein the elongated carbon nanoparticles are functionalized so as to at least partially solubilize the elongated carbon nanoparticles into the oil-soluble lubricating base fluid or the water-soluble lubricating base fluid.

Element 6: Wherein the elongated carbon nanoparticles are functionalized with a water-solubilizing group; an oil-solubilizing group; and any combination thereof.

Element 7: Wherein the water-solubilizing group is selected from the group consisting of a carboxyl group; a sulfonate group; a sulfate group; a phosphate group; a phosphonate group; a saccharide group; a nucleoside group; a nucleotide group; a peptide group; a glycol group; a polyethylene oxide group; a polyethylene glycol group; a hydroxyl group; a sulfuric acid ester group; an epoxide group; an aldehyde group; a carbonyl group; a haloformyl group; a carbonate ester group; an ester group; a methoxy group; a hydroperoxy group; a peroxy group; an ether group; a meiacetal group; a meniketal group; an acetal group; an orthoester group; an orthocarbonate ester group; and any combination thereof.

Element 8: Wherein the oil-solubilizing group is a hydrocarbyl group selected from the group consisting of an alkyl group; an alkenyl group; an alkynyl group; a phenyl group; an aryl group; a cycloalkyl group; a prenyl group; a trityl group; a methanidyl group; a adamantan-2-yl group; a cycloalkenyl group; a cycloalkatrienyl group; a cycloalkadienyl group; a $C_{60}$ fullerene group; and any combination thereof.

Element 9: Wherein the oil-soluble lubricating base fluid is selected from the group consisting of animal oil; vegetable oil; mineral oil; diesel oil, crude oil; a petroleum derivative; a glycol; an ester; a silicone; a stearate; a polyoxyethylene; an oil-soluble polymer; and any combination thereof.

Element 10: Wherein the water-soluble lubricating base fluid is selected from the group consisting of an aliphatic alcohol; a polyalkylene glycol; a di(alkylene)glycol; a monoalkyl ether of an alkylene glycol; a monoalkyl ether of a di(alkylene)glycol; and any combination thereof.

By way of non-limiting example, exemplary combinations applicable to A, B, C, and D include: A with 2, 5, and 6; B with 3, 5, 9, and 10; C with 3 and 9; D with 3, 4, and 10.

Therefore, the embodiments disclosed herein are well adapted to attain the ends and advantages mentioned as well as those that are inherent therein. The particular embodiments disclosed above are illustrative only, as the embodiments disclosed herein may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the embodiments disclosed herein. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A drill bit comprising:

a rotary joint defining a sealed segment and an unsealed segment, wherein the sealed segment comprises a high-temperature lubricant comprising an oil-soluble lubricating base fluid or a water-soluble lubricating base fluid and elongated carbon nanoparticles that align in flow in response to frictional forces in the oil-soluble lubricating base fluid or the water-soluble lubricating base fluid, the elongated carbon nanoparticles comprising an oxygen-containing functional group that serve as a chemical handle for functionalization so as to at least partially solubilize the elongated carbon nanoparticles into the oil-soluble lubricating base fluid or the water-soluble lubricating base fluid, the functionalization comprising a water-solubilizing group, an oil-solubilizing group, or a combination of a water-solubilizing group and an oil-solubilizing group.

2. The drill bit of claim 1, wherein the oil-soluble lubricating base fluid has a decomposition temperature of greater than about 200° C.

3. The drill bit of claim 1, wherein the water-soluble lubricating base fluid has a decomposition temperature of greater than about 120° C.

4. The drill bit of claim 1, wherein the elongated carbon nanoparticles are selected from the group consisting of graphene nanoribbons; carbon nanotubes; carbon nanohorns; and any combination thereof.

5. The drill bit of claim 4, wherein the graphene nanoribbons are in the range of from about 5 nm to about 50 nm in width and in the range of from about 100 nm to about 2 μm in length.

6. A method of drilling a subterranean formation comprising:

providing a drill bit comprising a rotary joint defining a sealed segment and an unsealed segment, wherein the sealed segment comprises a high-temperature lubricant comprising an oil-soluble lubricating base fluid or a water-soluble lubricating base fluid and elongated carbon nanoparticles that align in flow in response to frictional forces in the oil-soluble lubricating base fluid or the water-soluble lubricating base fluid, the elongated carbon nanoparticles comprising an oxygen-containing functional group that serve as a chemical handle for functionalization so as to at least partially solubilize the elongated carbon nanoparticles into the oil-soluble lubricating base fluid or the water-soluble lubricating base fluid, the functionalization comprising a water-solubilizing group, an oil-solubilizing group, or a combination of a water-solubilizing group and an oil-solubilizing group; and drilling a well bore in the subterranean formation with the drill bit.

7. The drill bit of claim 6, wherein the oil-soluble lubricating base fluid has a decomposition temperature of greater than about 200° C.

8. The drill bit of claim 6, wherein the water-soluble lubricating base fluid has a decomposition temperature of greater than about 120° C.

9. The method of claim 6, wherein the elongated carbon nanoparticles are selected from the group consisting of graphene nanoribbons; carbon nanotubes; carbon nanohorns; and any combination thereof.

10. The method of claim 9, wherein the graphene nanoribbons are in the range of from about 5 nm to about 50 nm in width and in the range of from about 100 nm to about 2 μm in length.

11. The drill bit of claim 1, wherein the elongated carbon nanoparticles are present in the range of from about 15% to about 80% by weight of the oil-soluble lubricating base fluid or the water-soluble lubricating base fluid.

12. The method of claim 6, wherein the elongated carbon nanoparticles are present in the range of from about 15% to about 80% by weight of the oil-soluble lubricating base fluid or the water-soluble lubricating base fluid.

* * * * *